United States Patent [19]

Ikeda et al.

[11] Patent Number: 4,900,175

[45] Date of Patent: Feb. 13, 1990

[54] PLATEN ASSEMBLY

[75] Inventors: Hiroshi Ikeda; Takashi Sawada, both of Saitama; Mitsuo Bansho, Tokyo, all of Japan

[73] Assignee: Citizen Watch Co., Ltd., Tokyo, Japan

[21] Appl. No.: 334,882

[22] Filed: Mar. 30, 1989

[30] Foreign Application Priority Data

Apr. 6, 1988 [JP] Japan ..... 63-45753[U]

[51] Int. Cl.[4] ..... B41J 11/04

[52] U.S. Cl. ..... 400/659; 400/648

[58] Field of Search ..... 400/659, 660, 661, 661.3, 400/648, 658

[56] References Cited

U.S. PATENT DOCUMENTS 3,393,789 7/1968 Keiter ..... 400/659

FOREIGN PATENT DOCUMENTS 1441348 8/1974 United Kingdom ..... 400/659

OTHER PUBLICATIONS

Mott, W. E., IBM Technical Disclosure–Platen Knob Securing Device, Mar. 1978, p. 3995.

Mott, W. E., IBM Technical Disclosure–Platen Knob Securing Device, Feb. 1977, p. 3472.

*Primary Examiner*—Edgar S. Burr

*Assistant Examiner*—Joseph R. Keating

*Attorney, Agent, or Firm*—Wenderoth, Lind & Ponack

[57] ABSTRACT

A platen assembly has a pipe shaft having an elastomeric layer therearound, an end of the pipe shaft having cutouts therein extending parallel to the axis thereof and having locking holes therein between the cutouts, and a power transmission member connected to the end of the pipe shaft, the power transmission member having first convexities removably engaged in the cutouts for holding the member against rotation relative to the pipe shaft, and second convexities resiliently removably engaged in the locking holes for holding the member against disengagement from the pipe shaft.

7 Claims, 2 Drawing Sheets

PLATEN ASSEMBLY

BACKGROUND OF THE INVENTION

1. Field of the Invention

The present invention relates to a platen assembly for supporting thereon printing paper printed in a printer.

2. Statement of the Prior Art

A conventional platen includes a solid shaft of a metal material and an elastic cylinder body of a rubbery elastomer, which is mounted around said shaft. Printing paper is held around the elastic cylinder body and is printed with a printing head.

However, such a conventional platen has an increased weight and inertia due to the elastic cylinder body having a large thickness relative to the solid shaft. A problem with such a platen has thus been that its responsiveness during rotational driving is so poor that not only is the printing speed slow but difficulty is encountered in controlling its rotational position. Another problem has been that when the temperature of the platen rises during continuous printing over an extended period of time and the rubber or other member expands so as to increase the diameter of the elastic cylinder body, there is a decrease in the distance between the platen and the printing head, which in turn causes deterioration of the quality of the printing and the feed pitch of the platen to be increased too much to be in alignment with that of a tractor, which in turn causes troubles such as jamming.

One way to solve such problems of the prior art platen is to change the solid shaft to a pipe shaft. In other words, the pipe shaft is used to reduce the increase in the weight of the platen, and an elastic cylinder body having a reduced thickness is provided therearound, whereby it is possible to obtain a platen of reduced weight and inertia, and it is possible to reduce the variation in the outer diameter of the rubber due to temperature changes. Such a platen is disclosed in, e.g., Japanese Utility Model Laid-Open No. 62-25556.

However, such a platen has a structure in which plug members are mounted at both ends of the pipe shaft by force fitting, welding or other means so as to rotatably support the platen on a frame by a thin supporting shaft inserted axially through the plug members. Thus, not only is there an increase in the number of parts involved, but high fit accuracy is required for force fitting, welding or other means. Besides, it is required to effect axial alignment of the supporting shaft after force fitting or welding, resulting in an uneconomical increase in the number of steps during assembling.

SUMMARY OF THE INVENTION

The present invention has for its object to solve the aforesaid problems of the prior art by providing a structure wherein a power transmission member including a gear, a knob and the like and a pipe shaft can be united together in the rotational and axial directions by a mere attachment of the former to an end of the latter.

According to the present invention, that object is achieved by the provision of a platen assembly including a pipe shaft having mounted therearound an elastic cylinder body, and a power transmission member connected to one end of said pipe shaft, wherein said pipe shaft is provided with locking holes and cutouts in said one end, and said power transmission member is provided with first convexities engaged within said cutouts to fix said member against rotation relative to the pipe shaft and second convexities engaged within said locking holes in an elastically deformable manner to hold said member against axial disengagement from the pipe shaft.

When the power transmission member is attached to the end of said pipe shaft, the first convexities of the member are fitted into the cutouts in the pipe shaft, while the second convexities of the member are fitted into the locking holes in the pipe shaft, whereby the pipe shaft and the power transmission member are united together in the rotational and axial directions.

BRIEF DESCRIPTION OF THE DRAWINGS

The present invention will now be explained in more detail with reference to the accompanying drawings, which are provided for the purpose of illustration alone, and in which.

DETAILED DESCRIPTION OF THE PREFERRED EMBODIMENTS

Figure 1:
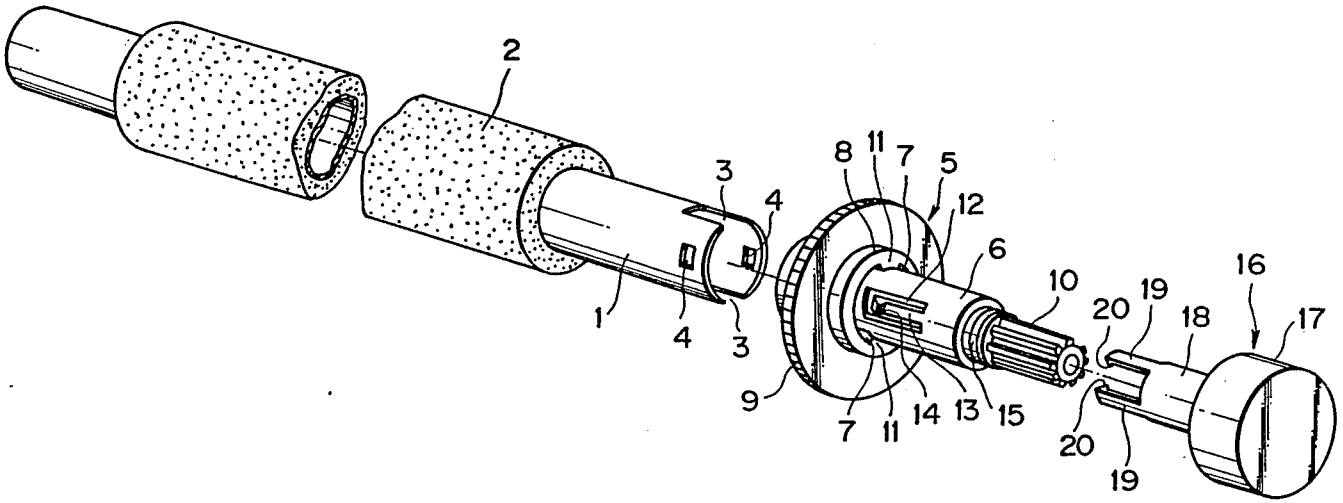
FIG. 1 is an exploded perspective view of one embodiment of the platen according to the present invention.
Figure 2:
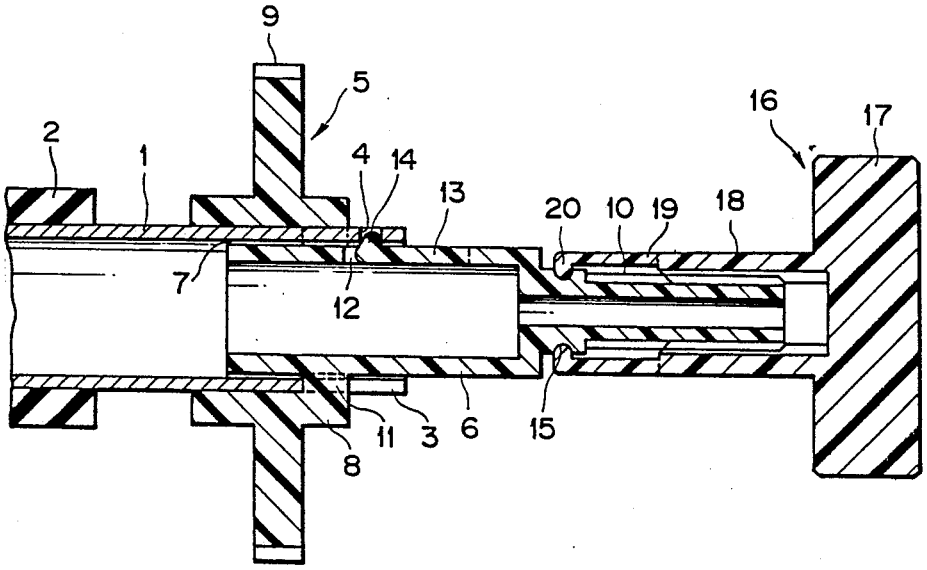
FIG. 2 is a longitudinal sectional view of the platen of FIG. 1 in the assembled condition.

Referring to the drawings, reference numeral 1 designates a pipe shaft of a metal material which is covered with a layer 2 of rubbery elastomer such as a light plastic other than at the outer ends. At one end of the pipe shaft 1 are two cutouts 3 which extend axially of the pipe shaft and which are open at the end face of the shaft, and two locking holes 4 spaced from the end face of the shaft a suitable distance. These cutouts 3 and locking holes 4 can be easily formed by, e.g. pressing.

Reference numeral 5 designates an integral power transmission member formed of hard plastic which includes a cylindrical shaft portion 6, a boss portion 8 coaxially mounted on one end of the shaft portion 6 and spaced radially outwardly thereof a suitable distance 7, a gear 9 mounted on the boss portion 8 and a spline shaft portion 10 disposed at the end of the shaft portion 6 opposite to the boss portion 8.

The cylindrical shaft portion 6 is joined to the boss portion 8 by means of two diametrically extending arms 11 which act as first convexities which fit into said cutouts 3 for preventing the shaft 6 from rotating. The inner diameter of the boss portion 8 is designed to correspond to the outer diameter of the pipe shaft 1 so as to make the pipe shaft 1 fit onto the shaft portion 6. In the cylindrical shaft portion 6, there is further provided two U-shaped grooves (only one is visible) having the opening of the U facing the spline shaft portion 10. The groove 12 defines an axially extending and elastically deformable locking arm 13, and its free end has an outward projection 14 thereon, which constitute second convexities. That projection 14 engages in one of the locking holes 4 for preventing the disengagement of the shaft portion 6 from pipe shaft 1. Reference numeral 15 designates a circumferentially continuous groove in the base end of the spline shaft portion 10.

A platen knob generally shown at 16 of hard plastic includes a grip portion 17, a spline cylinder portion 18 defined by an extension on one end of the portion 17 and a pair of stopper arms 19 extending axially from the outer end of the cylinder portion 18. The inside surface of the spline cylinder portion 18 has an inner splined portion which fits onto said spline shaft portion 10, and at the extreme ends of the stopper arms 19 there are inward projections 20 which engage in said circumferential groove 15.

A description will now be given of the operation of the above-described embodiment.

The assembling of the platen according to the instant embodiment can easily and surely be achieved by attaching the power transmission member 5 to the end of the pipe shaft 1 and, in turn, the platen knob 16 to the power transmission member 5.

More exactly, the end of the pipe shaft 1 is aligned with the space 7 in the power transmission member 5, whereupon the arms 11 of the power transmission member 5 are inserted into the cutouts 3 in the shaft 1 to position said member 5 in place. In this case, the projections 14 on the locking arms 13 are engaged with the end face of the pipe shaft 1, and are elastically urged inwardly due to their deformability, and upon further movement of the power transmission member and the pipe shaft, the projections 4 of the locking arms 13 are engaged within the locking holes 4.

The resulting fitting of the arms 11 into the cutouts 3 causes the pipe shaft 1 to be rotatable in unison with the power transmission member 5, while the resulting fitting of the projections 14 into the locking holes 4 causes the pipe shaft 1 to be fixed to the power transmission member 5 against movement in the axial direction. Thus, the connection of said pipe shaft 1 fixedly with the power transmission member 5 attaches the power transmission member 5 to the end of the pipe shaft 1.

To assemble the platen knob 16 in place, it is only necessary to insert the spline cylinder portion 18 over the spline shaft portion 10 of the power transmission member 5 and fit the projections 20 of the extreme ends of the stopper arms 19 into the circumferential groove 15 in the spline shaft portion 10, whereby the platen knob 16 is fixedly connected to the power transmission member 5 against movement in both the rotational and axial directions.

According to the present invention as described above, there is provided a platen assembly having a structure in which the pipe shaft is provided with locking holes and cutouts, and the power transmission member is provided with the first convexities which engage the cutouts to fix the power transmission member against rotation relative to the pipe shaft and the second convexities which engage the locking holes to fix the power transmission member against axial disengagement from the pipe shaft. In this way, the two members can be easily and surely connected and fixed to each other by such attachment alone without troublesome recentering. In addition, the present platen assembly assures that the outer face of the elastic cylinder body has high concentricity with respect to the pipe shaft, undergoes less changes in the outer diameter with temperature changes, has reduced weight and has good responsiveness to high-speed rotation.

What is claimed is:

1. A platen assembly comprising:

a pipe shaft having an elastomeric layer therearound, an end of said pipe shaft having cutouts therein extending parallel to the axis thereof and having locking holes therein between said cutouts; and a power transmission member connected to said end of said pipe shaft, said power transmission member having first convexities removably engaged in said cutouts for holding said member against rotation relative to said pipe shaft, and second convexities resiliently removably engaged in said locking holes for holding said member against disengagement from said pipe shaft.

2. A platen assembly as claimed in claim 1 in which said power transmission member has a circumferential space therein having radially extending arms extending thereacross which constitute said first convexities, said radially extending arms being movable into said cutouts as said power transmission member is moved onto said pipe shaft with the pipe shaft passing through said circumferential space.

3. A platen assembly as claimed in claim 2 in which said power transmission member has a cylindrical shaft portion and an annular boss having a gear therearound and spaced therefrom to define said circumferential space, and said radially extending arms being on one of said boss and said cylindrical shaft portion.

4. A platen assembly as claimed in claim 3 in which said radially extending arms are on said boss.

5. A platen assembly as claimed in claim 1 in which said power transmission member has a plurality of arms thereon extending parallel to the axis thereof and resiliently movable radially of said member, said arms having radially extending projections thereon constituting said second convexities.

6. A platen assembly as claimed in claim 5 in which said power transmission member has a cylindrical shaft portion having a plurality of U-shaped grooves therein defining said arms.

7. A platen assembly as claimed in claim 6 in which said projections on said arms project radially outwardly and said arms are resiliently movable inwardly of said cylindrical shaft portion as said power transmission member is moved onto said end of said pipe shaft for causing said projections to be moved inwardly and along the inner surface of said pipe shaft and then radially outwardly into said locking holes.

* * * * *